United States Patent [19]

Ishikawa et al.

[11] Patent Number: 4,765,296

[45] Date of Patent: Aug. 23, 1988

[54] THROTTLE VALVE CONTROL FOR INTERNAL COMBUSTION ENGINE

[75] Inventors: Yoshikazu Ishikawa; Kouji Yamaguchi; Takeo Suzuta, all of Wako, Japan

[73] Assignee: Honda Giken Kogyo Kabushiki Kaisha, Tokyo, Japan

[21] Appl. No.: 58,915

[22] Filed: Jun. 5, 1987

[30] Foreign Application Priority Data

Jun. 6, 1986 [JP] Japan ..... 61-131555

[51] Int. Cl.[4] ..... F02D 11/10

[52] U.S. Cl. ..... 123/399; 123/361

[58] Field of Search ..... 123/399, 361, 340

[56] References Cited

U.S. PATENT DOCUMENTS

| | | | |
|---|---|---|---|
| 4,453,516 | 6/1984 | Filsinger | 123/399 X |
| 4,470,396 | 9/1984 | Hasumi et al. | 123/399 X |
| 4,519,361 | 5/1985 | Murakami | 123/399 |
| 4,691,676 | 9/1987 | Kiluchi | 123/399 |
| 4,691,677 | 9/1987 | Hotate et al. | 123/399 |

FOREIGN PATENT DOCUMENTS

| | | | |
|---|---|---|---|
| 2154765 | 9/1985 | United Kingdom | 123/399 |

*Primary Examiner*—Tony M. Argenbright
*Assistant Examiner*—Eric R. Carlberg
*Attorney, Agent, or Firm*—Birch, Stewart, Kolasch & Birch

[57] ABSTRACT

A throttle valve control apparatus for a vehicle engine, whereby a reference degree of opening of the throttle valve is derived based on the accelerator pedal actuation position and is then corrected in accordance with vehicle operating conditions to obtain a target degree of opening of the throttle valve. An upper limit opening degree and a lower limit opening degree of the throttle valve are also derived, and if the target opening degree, which is obtained on the basis of the vehicle operating conditions, is found to be greater than the upper limit opening degree, then the upper limit opening degree is used as the target opening degree. Similarly, if the target opening degree, which is determined from the vehicle operating conditions, is less than the lower limit opening degree, then the lower limit opening degree is used as the target opening degree. The throttle valve is driven at a controlled drive speed so as to reduce any deviation between the actual degree of opening and the target degree of opening of the throttle valve.

5 Claims, 6 Drawing Sheets

THROTTLE VALVE CONTROL FOR INTERNAL COMBUSTION ENGINE

BACKGROUND OF THE INVENTION

1. Field of Technology

The present invention relates to a throttle valve control apparatus for an internal combustion engine which drives a motor vehicle, whereby a degree of the throttle valve opening is controlled in accordance with an accelerator pedal actuation.

2. Background Technology

A throttle valve control apparatus for an internal combustion engine is known in the prior art, whereby the actuation position of an accelerator pedal is detected and a throttle valve is driven in accordance with the relationship between the detected actuation position and a predetermined throttle valve opening degree characteristic (Japanese Patent Laid-open No. 59-99045). Furthermore, a throttle valve control apparatus has been described (Japanese Patent Laid-open No. 59-74341), whereby a plurality of different throttle valve opening degree characteristics relating to an accelerator pedal actuation position are stored in a memory beforehand, and an opening degree characteristic is manually selected from among these stored characteristics by means such as a switch.

With such a prior art throttle valve control apparatus in which a manual selection of the throttle valve opening degree characteristic is performed, the opening degree characteristic can be selected, for example, so as to place emphasis upon improved control of the engine output power under a condition of low load operation. However, if the vehicle driver rapidly depresses the accelerator pedal in order to produce rapid acceleration so that emphasis is placed upon improved control under a low load operation, then the vehicle will operate so as to provide an impression of comparatively poor response to the demand for acceleration. Conversely, if the throttle valve opening degree characteristic is selected so as to emphasize excellent acceleration capability, then it will be difficult to achieve a fine degree of control of the engine output power by means of the accelerator pedal. These disadvantages can clearly be avoided if the throttle valve opening degree characteristic is selected so as to be appropriate for the current running condition of the vehicle. However, it would be difficult for the driver to continuously select the most suitable throttle valve opening degree characteristic during vehicle operation, so that in fact such a method would lead to a lowering of engine performance.

SUMMARY OF THE INVENTION

It is an objective of the present invention to provide a throttle valve control apparatus whereby an optimum throttle valve opening degree characteristic is derived during operation of a vehicle, so that excellent accelerator response and control capabilities are ensured.

A throttle valve control apparatus according to the present invention includes opening degree setting means for establishing a target degree of opening of the throttle valve. First, a reference degree of opening of the throttle valve with respect to the accelerator pedal actuation position is derived. This reference degree of opening is then corrected in accordance with the current running conditions of the motor vehicle to thereby obtain a target degree of opening of the throttle valve. In addition, an upper limit opening degree and a lower limit opening degree of the throttle valve are respectively derived with respect to the accelerator pedal actuation position. If the target opening degree that was obtained on the basis of the vehicle running conditions is found to be greater than the upper limit opening degree of the throttle valve, then this upper limit opening degree is produced as an output from the opening degree setting means which expresses the target opening degree that is actually utilized. Similarly, if the target opening degree that was obtained in accordance with the vehicle running conditions is found to be lower than the lower limit opening degree, then the lower limit opening degree is produced as an output expressing the target opening degree which is actually utilized. The throttle valve is then driven at a specifically determined drive speed so as to reduce any deviation between the actual throttle valve degree of opening of the throttle valve and the target opening degree of the throttle valve.

More specifically, a throttle valve control apparatus according to the present invention comprises accelerator actuation detection means for producing an output in accordance with an actuation position of an accelerator pedal, opening degree setting means for setting a target degree of opening of the throttle valve based on the actuation position of the accelerator pedal thus detected to thereby generate an output which expresses the target degree of opening of the throttle valve, throttle valve opening degree detection means for producing an output in accordance with an actual degree of opening of the throttle valve. Furthermore, drive speed setting means for setting a speed for driving the throttle valve in accordance with running conditions of a motor vehicle, drive means for driving the throttle valve at the drive speed which has thus been set so as to reduce a deviation between the detected actual degree of opening of the throttle valve and the target degree of opening of the throttle valve which is obtained from the output of the opening degree setting means, wherein the opening degree setting means functions to derive a reference degree of opening of the throttle valve in accordance with the actuation position of the accelerator pedal and to correct the reference degree of opening of the throttle valve in accordance with vehicle running conditions to thereby establish a target degree of opening of the throttle valve. Moreover, an upper limit degree and a lower limit degree for opening of the throttle valve are derived respectively with respect to the actuation position of the accelerator pedal and an output which expresses the target degree of opening as the upper limit degree of opening is generated in the event that the target degree of opening which is set in accordance with the vehicle running conditions exceeds the upper limit degree of opening. Furthermore, an output which expresses the target degree of opening as the lower limit degree of opening is generated in the event that the target degree of opening which is set in accordance with the vehicle running conditions is smaller than the lower limit degree of opening.

DETAILED DESCRIPTION OF THE PREFERRED EMBODIMENT

Figure 1:
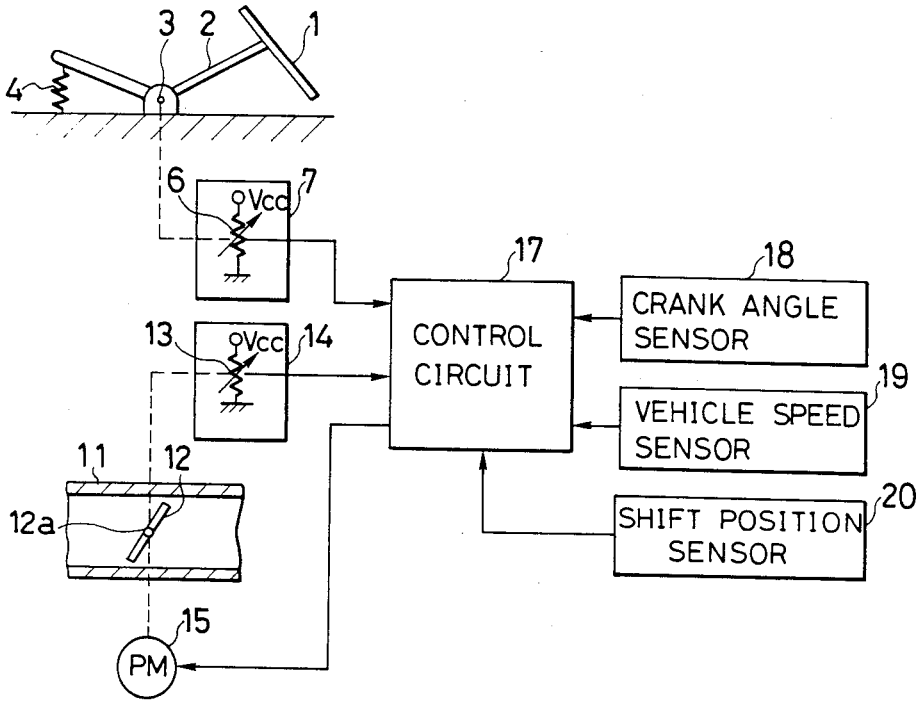
FIG. 1 is a general diagram to illustrate an embodiment of the present invention.

The invention will be described referring first to FIG. 1, which shows an embodiment of the present invention with a throttle valve control apparatus for an internal combustion engine which is mounted in a motor vehicle. In FIG. 1, an accelerator pedal 1 is coupled to one end of an angle bracket 2 which is rotatably mounted on the floor of a vehicle by a shaft 3. A return spring 4 is coupled to the other end of bracket 2, and urges the accelerator pedal 1 upwards to an idling position. An accelerator actuation position sensor 7 consisting of a potentiometer 6 is coupled to the shaft 3, and an output voltage is produced in accordance with the actuation position of the accelerator pedal 1, i.e. in accordance with the accelerator angle. This angle is defined as the angle through which the shaft 3 is rotated about the axis thereof, from the idling position of the accelerator pedal 1.

A throttle valve opening degree sensor 14 consists of a potentiometer 13 which is coupled to a shaft 12*a* of throttle valve 12, mounted in the engine intake pipe, and an output voltage is generated in accordance with the degree of opening of throttle valve 12. The shaft 12*a* is also coupled to the drive shaft of a pulse motor 15.

The sensors 7 and 14 and the motor 15 are connected to a control circuit 17. Control circuit 17 is also connected to a crank angle sensor 18 which generates a pulse each time that the engine crankshaft (not shown in the drawings) rotates into a specific crank angle (e.g. corresponding to a top dead center position), and control circuit 17 is further connected to a speed sensor 19 which generates an output varying in accordance with the speed of the vehicle. Control circuit 17 is further connected to a shift position sensor 20 which detects the gear shift position of the vehicle transmission (not shown in the drawings). In this example, the vehicle transmission is assumed to have five forward speeds. The shift position sensor 20 can for example include a plurality of switches coupled to the gear shift lever of the vehicle, each of which produces a "High" logic level output signal when set in the closed state, to thereby derive binary coded digital signals in accordance with the gear shift position.

Figure 2:
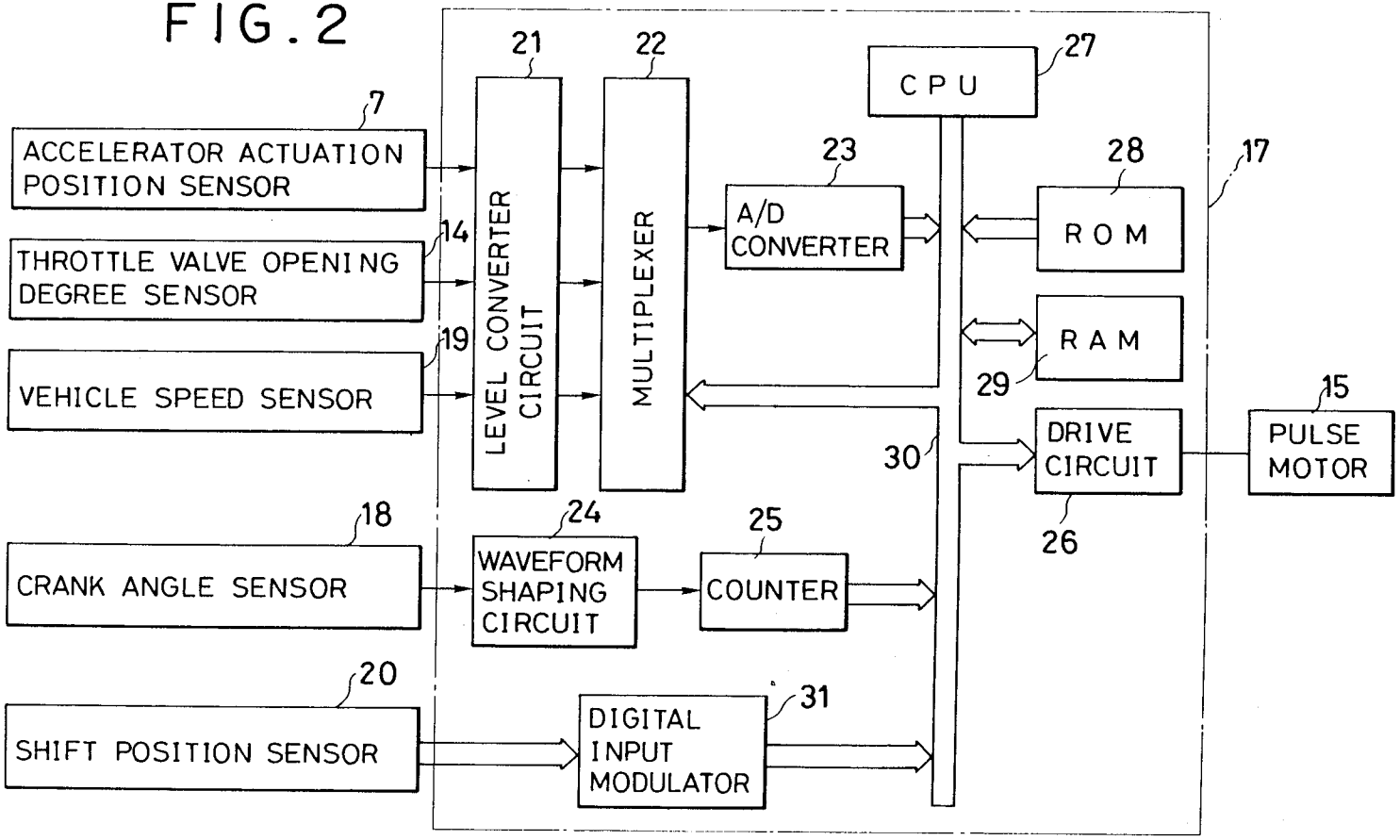
FIG. 2 is a circuit diagram of a specific example of a control circuit used in the embodiment of FIG. 1.

As shown in FIG. 2, the control circuit 17 contains a level converter circuit 21 which performs level conversions of the outputs from the accelerator actuation position sensor 7, the throttle valve opening degree sensor 14, and the vehicle speed sensor 19. Control circuit 17 also includes a multiplexer 22 which receives the level-converted output voltages from level converter circuit 21 and selects one of these to be produced as output, an A/D converter 23 which performs analog-digital conversions of the selected output voltage from multiplexer 22, a waveform shaping circuit 24 which performs waveform shaping of the output signals from crank angle sensor 18, a counter 25 which counts a number of clock pulses that are produced from a clock pulse generating circuit (not shown in the drawings) during each interval between the generation of successive TDC (Top Dead Center) signal pulses output from waveform shaping circuit 24, and a digital input modulator 31 which converts the output signal from the shift position sensor 20 to a digital code signal and includes decoders, etc. Control circuit 17 further includes a drive circuit 26 which drives the pulse motor 15, a CPU (Central Processing Unit) 27 which performs digital operations in accordance with a program, a ROM (Read-only Memory) 28 which stores programs and data having been written therein prior to operation of the apparatus of the invention, and a RAM (Random Access Memory) 29. The multiplexer 22, A/D converter 23, counter 25, drive circuit 26, digital input modulator 31, CPU 27, ROM 28 and RAM 29 are mutually interconnected by a bus 30. Although not shown in the drawings, the CPU 27 receives clock pulses from a clock pulse generating circuit.

The operation of the embodiment is as follows. Respective data for an accelerator angle $\theta_{ACC}$, a throttle valve degree of opening $\theta_{th}$, and a throttle valve opening degree characteristic command supplied from A/D converter 23 are selectively transferred to the CPU 27 over the bus 30. In addition, data representing the engine speed of rotation $N_e$, and data representing the vehicle gear shift position (produced from digital input modulator 31) are sent to CPU 27 over bus 30. The CPU 27 executes a read-in operation of the respective data in accordance with a processing program which is stored in ROM 28, with the read-in being performed in synchronism with the clock pulses. CPU 27 thereby processes as described hereinafter for generating commands which are supplied to the drive circuit 26 to drive the pulse motor 15. These commands consist of pulse motor valve-opening drive commands, pulse motor valve-closing drive commands, and pulse motor drive halt commands (whereby driving of pulse motor 15 is halted).

Figure 3A:
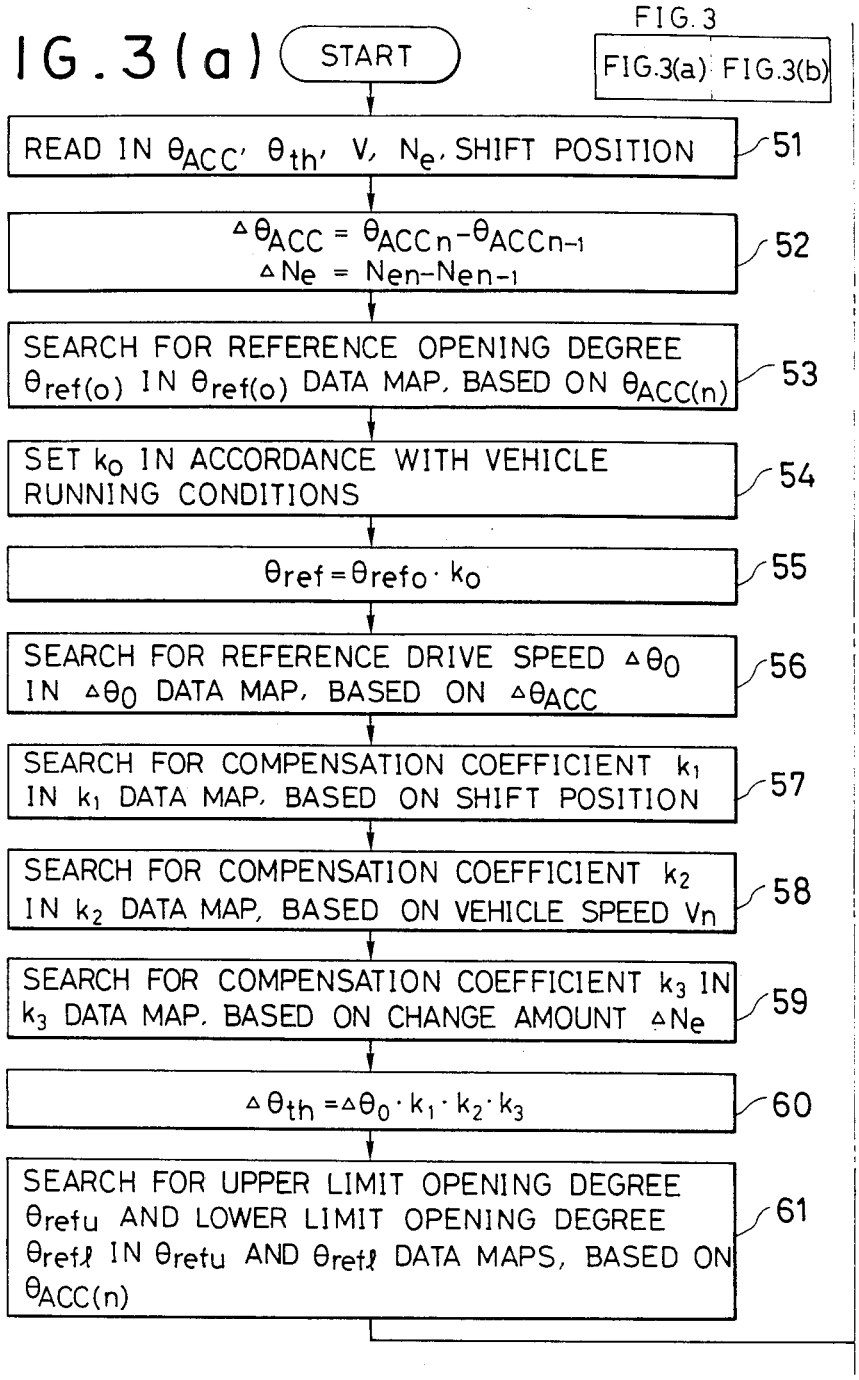
FIG. 3 is a flow chart for assistance in describing the operation of a CPU shown in FIG. 2.
Figure 3B:
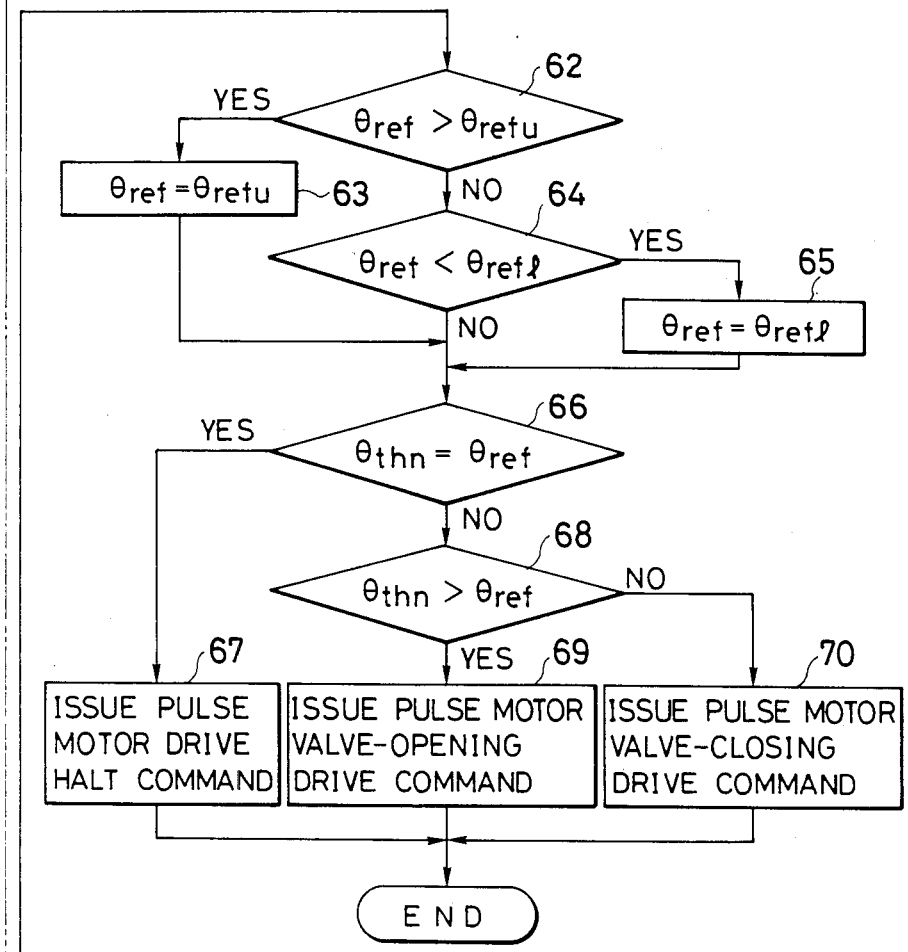

The operation of this embodiment will be described with reference to the operating flow chart of CPU 27 shown in FIG. 3. The execution process of a program by CPU 27, which is performed periodically is illustrated.

Figure 5:
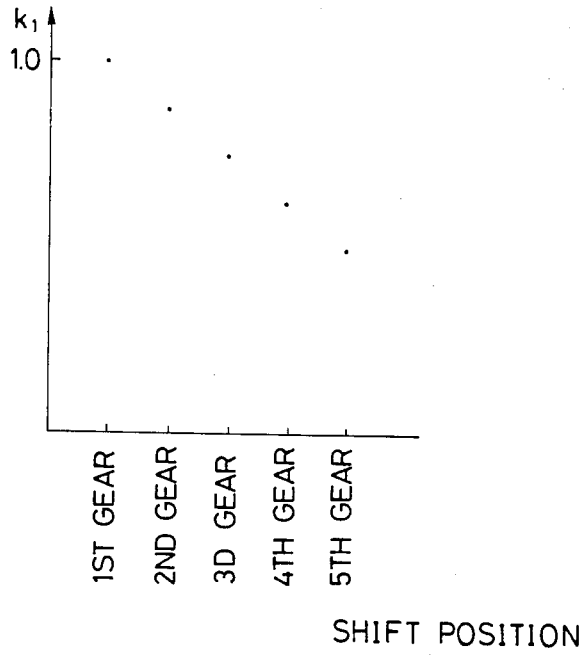
Figure 6:
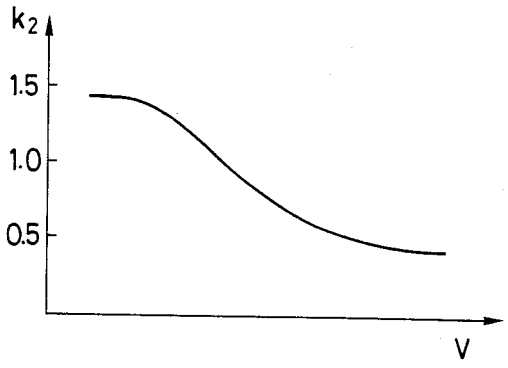
Figure 7:
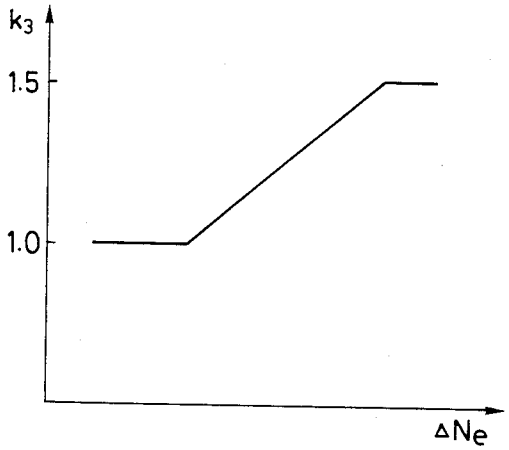
Figure 8:
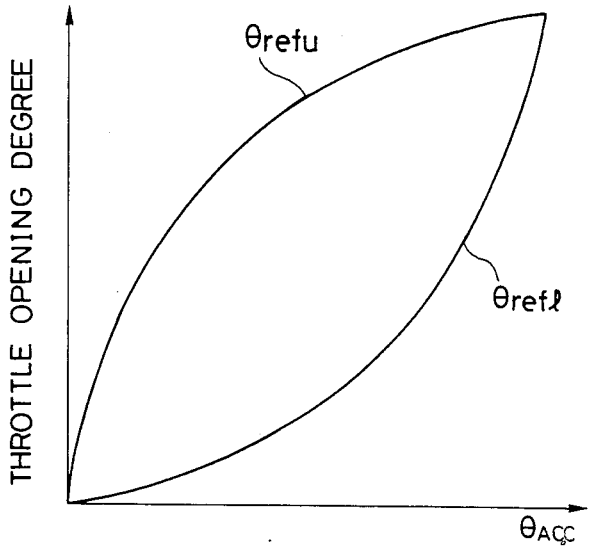

CPU 27 executes a read-in operation at predetermined periodic intervals of the accelerator angle $\theta_{ACC}$, the throttle valve opening degree $\theta_{th}$, the vehicle speed V, the engine speed of rotation $N_e$, and the gear shift position, etc. (step 51). A unit amount of change $\Delta\theta_{ACC}$ is obtained from the difference between accelerator angle $\theta_{ACC(n)}$ which is read in by the current program execution and the accelerator angle $\theta_{ACC(n-1)}$ which was read in during the preceding program execution, and a unit amount of change $\Delta N_e$ is obtained from the difference between the engine speed of rotation $N_{e(n)}$ which is read in by the current program execution and the engine speed of rotation $N_{e(n-1)}$ which was read in during the preceding execution of the program (step 52). Next, the reference degree of opening $\theta_{ref(o)}$ of throttle valve 12 is obtained by searching a $\theta_{ref(o)}$ data map which has been stored beforehand in ROM 28, the search is performed based on the accelerator angle $\theta_{ACC(n)}$ (step 53). A compensation coefficient $k_o$ is then set in accordance with the running conditions of the vehicle (step 54), and a target degree of opening $\theta_{ref}$ of the throttle valve 12 is computed by multiplying the reference degree of opening $\theta_{ref(o)}$ by the compensation coefficient $k_o$ (step 55). The compensation coefficient $k_o$ can for example be established on the basis of the idling speed of the engine, the altitude at which the vehicle is being operated, the characteristics of the vehicle transmission system, the vehicle speed V, the engine speed of rotation $N_e$, and the operating status of the vehicle heater, etc. A throttle valve drive speed $\Delta\theta_o$ is then obtained with respect to the amount of change $\Delta\theta_{ACC}$ computed in step 52, by searching a $\Delta\theta_o$ data map which has been stored beforehand in ROM 28 and corresponds to the characteristics shown in FIG. 4 (step 56). A compensation coefficient $k_1$ is then obtained in accordance with the gear shift position (i.e. in accordance with the current position of the gear shift among the first to the fifth positions), by searching a $k_1$ data map which has been stored beforehand in ROM 28 and which corresponds to the characteristic shown in FIG. 5 (step 57). A compensation coefficient $k_2$ is then obtained in accordance with the vehicle speed $V_n$ which has been read in during this program execution, with $k_2$ being obtained by searching a $k_2$ data map which has been stored beforehand in ROM 28 and corresponds to the characteristic shown in FIG. 6 (step 58). In addition, a compensation coefficient $k_3$ that is obtained in accordance with the amount of change $\Delta N_e$ of the engine rotation speed $N_e$, with $k_3$ being obtained by searching a $k_3$ data map which has been stored beforehand in ROM 28 and corresponds to the characteristics shown in FIG. 7 (step 59). When compensation coefficients $k_1$, $k_2$ and $k_3$ have thus been obtained, the drive speed $\Delta\theta_{th}$ is computed by multiplying the reference drive speed $\Delta\theta_o$ by $k_1$, $k_2$ and $k_3$ (step 60). Next, an upper limit opening degree $\theta_{refu}$ and a lower limit opening degree $\theta_{refl}$ are respectively obtained on the basis of the accelerator angle $\theta_{ACC(n)}$, by searching a $\theta_{refu}$ and a $\theta_{refl}$ data map respectively, which have been stored beforehand in ROM 28 (step 61). The $\theta_{refu}$ and the $\theta_{refl}$ data maps respectively correspond to the upper limit opening degree $\theta_{refu}$ characteristics and the lower limit opening degree $\theta_{refl}$ characteristics shown in FIG. 8, each of which is based upon the values of accelerator angle $\theta_{ACC}$. After obtaining the upper limit opening degree $\theta_{refu}$ and lower limit opening degree $\theta_{refl}$ in this way, a decision is made as to whether or not the target degree of opening $\theta_{ref}$ is greater than the upper limit opening degree $\theta_{refu}$ (step 62). If $\theta_{ref} > \theta_{refu}$, then the upper limit opening degree $\theta_{refu}$ is set as the target opening degree $\theta_{ref}$ (step 63). If $\theta_{ref} \geqq \theta_{refu}$, then a decision is made on whether or not the target opening degree $\theta_{ref}$ is smaller than the lower limit opening degree $\theta_{refl}$ (step 64). If $\theta_{ref} < \theta_{refl}$, then the lower limit opening degree $\theta_{refl}$ is set as the target opening degree $\theta_{ref}$ (step 65). However, if $\theta_{ref} \geqq \theta_{refl}$, then the value of target opening degree $\theta_{ref}$ which was computed in step 55 is held unchanged. After thus obtaining the target opening degree $\theta_{ref}$, a decision is made on whether or not the throttle valve degree of opening $\theta_{th(n)}$ which has been read in during this program execution is equal to the target opening degree $\theta_{ref}$ (step 66). If $\theta_{th(n)} = \theta_{ref}$, then a pulse motor drive halt command is issued to the drive circuit 26 (step 67). If $\theta_{th(n)} \neq \theta_{ref}$, then a decision is made on whether or not the $\theta_{th(n)}$ is greater than the target opening degree $\theta_{ref}$ (step 68). If $\theta_{th(n)} > \theta_{ref}$, then a pulse motor valve-closing drive command is issued to the drive circuit 26 for driving the throttle valve in the closing direction at the drive speed $\Delta\theta_{th}$. This drive command includes drive speed $\Delta\theta_{th}$ data (step 69). If $\theta_{th(n)}$ is not greater than $\theta_{ref}$, so that $\theta_{th(n)}$ must be less than $\theta_{ref}$, then a pulse motor valve-opening drive command is issued to the drive circuit 26 for driving throttle valve in the opening direction at drive speed $\Delta\theta_{th}$. This command includes drive speed $\Delta\theta_{th}$ data (step 70).

The pulse motor valve-closing drive command and the pulse motor valve-opening drive command can each consist of 8 bits, with two of these bits expressing the drive/halt conditions and the drive direction, and with the remaining 6 bits expressing the drive speed $\Delta\theta_{th}$. The drive circuit 26 can, for example, include a frequency synthesizer PLL (phase lock loop) circuit which generates an oscillator signal at a frequency in accordance with the drive speed $\Delta\theta_{th}$ data, a waveform shaping circuit for performing waveform shaping to convert this oscillator signal to a pulse signal, and a logic circuit for selectively enabling and inhibiting the supply of this pulse signal to the pulse motor 15 in accordance with the drive command data. The drive circuit 26 thereby supplies first drive pulses to the pulse motor 15 in response to a pulse motor valve-opening drive command, with the repetition period of these first drive pulses being in accordance with the drive speed $\Delta\theta_{th}$. The pulse motor 15 thereby rotates in a forward direction for driving the throttle valve 12 in the valve opening direction at the drive speed $\Delta\theta_{th}$. Similarly, when a pulse motor drive-closing drive command is issued, second drive pulses of opposite phase to the first drive pulses are supplied to pulse motor 15 with the repetition period of these second drive pulses being in accordance with the drive speed $\Delta\theta_{th}$, whereby the pulse motor 15 is driven to rotate in the reverse direction so that the throttle valve 12 is driven in the valve closing direction at drive speed $\Delta\theta_{th}$. Furthermore, when a pulse motor drive halt command is issued, the supply of drive pulses to the pulse motor 15 is halted, whereby rotation of pulse motor 15 is halted and the degree of opening of the throttle valve at that time is held unchanged.

In this way, the throttle valve 12 is driven to a degree of opening which is identical to the target opening degree $\theta_{ref}$, with the speed at which throttle valve 12 is driven being increased in accordance with an increasing speed of depression of the accelerator pedal, and being reduced in accordance with a movement of the gear shift position towards a higher speed gear (i.e. from a low gear to a higher gear), and moreover, being reduced in accordance with a reduction of the vehicle speed, and increased in accordance with an increasing amount of change in the engine rotation speed. Furthermore, if the target opening degree $\theta_{ref}$ computed in step 55 is found to exceed the upper limit opening degree characteristic shown in FIG. 8, then a degree of opening obtained from this characteristic is established as the target opening degree $\theta_{ref}$. Conversely, if the target opening degree $\theta_{ref}$ computed in step 55 is found to fall below the lower limit opening degree characteristic, then a degree of opening obtained from that characteristic is established as the target opening degree $\theta_{ref}$. In this way, the degree of opening of a throttle valve 12 is held to a value which is between the upper limit opening degree and lower limit opening degree characteristics.

In the embodiment of the present invention described above, the vehicle gear shift position is determined by means of a shift position sensor. However, it would be equally possible to detect the gear shift position from the ratio of the vehicle speed to the engine speed of rotation $N_e$.

Figure 4:
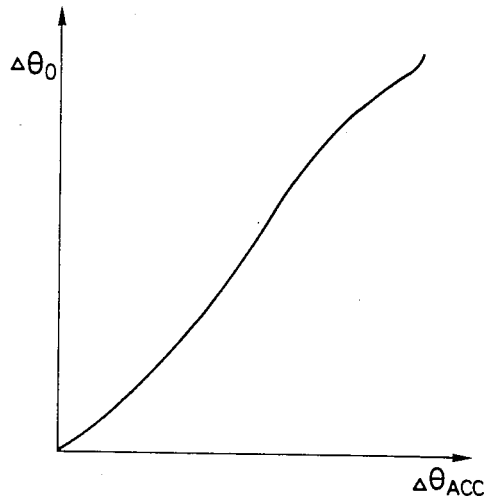
FIG. 4 through FIG. 9 show respective characteristics which are stored as data maps in a ROM.
Figure 9:
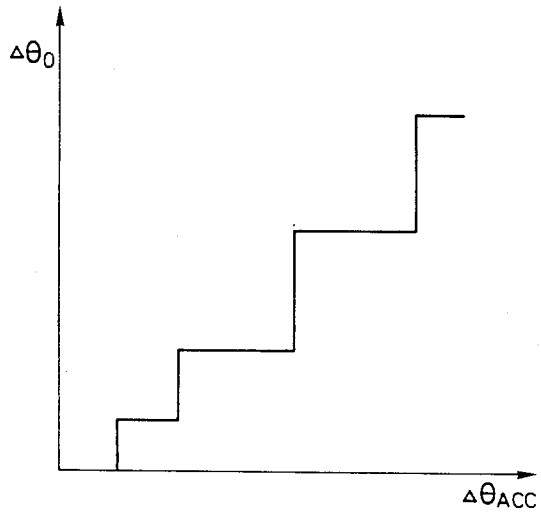

Furthermore, with the embodiment of the present invention described above, the throttle valve reference drive speed $\Delta\theta_o$ varies continuously with respect to the amount of change $\Delta\theta_{ACC}$, as shown in FIG. 4. However, it would also be possible to arrange for the throttle valve reference drive speed $\Delta\theta_o$ vary in a stepwise manner with respect to $\Delta\theta_{ACC}$, as shown in FIG. 9.

With a throttle valve control apparatus according to the present invention as described hereinabove, a reference degree of opening of a throttle valve is set corresponding to a detected actuation position of an accelerator pedal. This reference degree of opening is corrected in accordance with running conditions of the vehicle to thereby establish a target opening degree of the throttle valve. The throttle valve is controlled to be opened to a degree which is identical to this target opening degree, which is determined in accordance with the vehicle operating conditions. Furthermore, an upper limit and lower limit opening degree of the throttle valve are respectively established, as determined by the actuation position of the accelerator pedal, and if the target opening degree which was set in accordance with the vehicle running conditions should exceed the upper limit opening degree, then the upper limit opening degree is set as the target opening degree. Conversely, if the target opening degree which was set in accordance with the vehicle running conditions is found to be below the lower limit opening degree, then the lower limit opening degree is set as the target opening degree. In this way, rapid fluctuations in the state of the throttle valve opening are prevented, so that the throttle control can be smoothly varied. Moreover, an optimum throttle valve opening degree characteristic is obtained while the vehicle is running, so that excellent driving performance is assured.

What is claimed is:

1. A throttle valve control apparatus for controlling a degree of opening of throttle valve disposed in an intake system of an internal combustion engine, comprising:

accelerator actuation detection means for developing an output in response to an actuation position of an accelerator pedal;

opening degree setting means for setting a target degree of opening of the throttle valve based on the actuation position of the accelerator pedal thus detected, thereby generating an output which expresses the target degree of opening;

throttle valve opening degree detection means for developing an output in response to an actual degree of opening of the throttle valve;

drive speed setting means for setting a speed for driving the throttle valve in response to running conditions of the internal combustion engine; and drive means for driving the throttle valve at said speed which has been set, so as to reduce deviations between said target degree of opening which are obtained from the opening degree setting means;

wherein said opening degree setting means derives a reference degree of opening of the throttle valve in response to the actuation position of the accelerator pedal, and corrects said reference degree of opening in response to the running conditions, thereby establishing said target degree of opening, and moreover, and upper limit degree of opening and a lower limit degree of opening of the throttle valve are respectively derived with respect to the actuation position of the accelerator pedal and an output is generated which expresses said target degree of opening as said upper limit degree of opening when said target degree of opening is greater than said upper limit degree of opening, and furthermore an output is generated which expresses said target degree of opening as said lower limit degree of opening when said target degree of opening is less than said lower limit degree of opening.

2. A throttle valve control apparatus according to claim 1, wherein said drive speed setting means increases the speed for driving the throttle valve in response to an increase in the speed of depressing the actuation position of the accelerator pedal.

3. A throttle valve control apparatus according to claim 1, wherein said drive speed setting means establishes a succession of reduced speeds for driving the throttle valve in response to movements of a vehicle gear shift position towards a higher speed gear position.

4. A throttle valve control apparatus according to claim 1, wherein said drive speed setting means reduces the speed for driving the throttle valve as the vehicle speed is increased.

5. A throttle valve control apparatus according to claim 1, wherein said drive speed setting means increases the speed for driving the throttle valve as degrees of change in the speed of rotation of the internal combustion engine increase.

* * * * *